US009481439B1

(12) United States Patent
Groeschel et al.

(10) Patent No.: US 9,481,439 B1
(45) Date of Patent: Nov. 1, 2016

(54) STERN DRIVES HAVING VIBRATION ISOLATION

(71) Applicant: Brunswick Corporation, Lake Forest, IL (US)

(72) Inventors: John A. Groeschel, Theresa, WI (US); David J. Waldvogel, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 88 days.

(21) Appl. No.: 14/560,550

(22) Filed: Dec. 4, 2014

(51) Int. Cl.
*B63H 23/34* (2006.01)
*B63H 21/30* (2006.01)

(52) U.S. Cl.
CPC ..... *B63H 21/305* (2013.01); *B63H 23/34* (2013.01)

(58) Field of Classification Search
CPC ..... B63H 21/305
See application file for complete search history.

(56) References Cited

U.S. PATENT DOCUMENTS

| | | | | |
|---|---|---|---|---|
| 2,977,923 | A | 4/1961 | Bergstedt | |
| 3,136,287 | A | 6/1964 | North | |
| 3,376,842 | A | 4/1968 | Wynne | |
| 3,982,496 | A | 9/1976 | Blanchard | |
| 4,040,378 | A | 8/1977 | Blanchard | |
| 4,178,873 | A | 12/1979 | Bankstahl | |
| 4,526,002 | A | 7/1985 | Bibow | |
| 4,645,464 | A * | 2/1987 | Rawlings | B63H 20/10 440/57 |
| 4,773,215 | A | 9/1988 | Winberg et al. | |
| 4,940,434 | A | 7/1990 | Kiesling | |
| 5,352,141 | A | 10/1994 | Shields et al. | |
| 5,376,034 | A | 12/1994 | Meisenburg et al. | |
| 5,707,263 | A * | 1/1998 | Eick | B63H 20/10 440/61 F |
| 6,287,159 | B1 * | 9/2001 | Polakowski | B63H 21/305 440/111 |
| 6,299,496 | B1 | 10/2001 | Griffiths et al. | |
| 7,018,255 | B1 | 3/2006 | Phillips et al. | |
| 7,294,031 | B1 | 11/2007 | Davis et al. | |
| 7,354,324 | B1 | 4/2008 | Jaszewski et al. | |
| 7,387,556 | B1 | 6/2008 | Davis | |
| 8,011,983 | B1 | 9/2011 | Davis et al. | |
| 2005/0272321 | A1 | 12/2005 | Mansson | |

OTHER PUBLICATIONS

U.S. Appl. No. 14/267,441, filed May 1, 2014.
U.S. Appl. No. 14/287,888, filed May 27, 2014.

* cited by examiner

*Primary Examiner* — Edwin Swinehart
(74) *Attorney, Agent, or Firm* — Andrus Intellectual Property Law, LLP

(57) ABSTRACT

A stern drive is for a marine vessel. The stern drive comprises a gimbal housing that is configured for connection to the marine vessel, a gimbal ring that is steerable with respect to the gimbal housing about a vertical steering axis, a driveshaft housing that is connected to the gimbal ring, and a trim actuator that is configured to trim the driveshaft housing about a horizontal trim axis. The trim actuator has a first end that is pivotably connected to the gimbal ring at a horizontal first pivot axis and a second end that is pivotably connected to the driveshaft housing at a horizontal second pivot axis. A resilient driveshaft housing vibration isolator is located along the second pivot axis. The resilient vibration isolator isolates vibration forces on the driveshaft housing. A resilient gimbal ring vibration isolator is located along the trim axis. The gimbal ring vibration isolator isolates vibration forces on the gimbal ring.

14 Claims, 6 Drawing Sheets

STERN DRIVES HAVING VIBRATION ISOLATION

FIELD

The present disclosure relates to stern drives and apparatuses for mounting stern drives to marine vessels.

BACKGROUND

The following U.S. Patents, Publication and Application are incorporated herein by reference:

U.S. Pat. Nos. 2,977,923 and 3,136,287 disclose inboard-outboard mounting arrangements for marine drives.

U.S. Patent Publication No. 2005/0272321 discloses a boat hull with an outboard drive.

U.S. Pat. No. 7,294,031 discloses a marine vessel and drive combination that has upper and lower mounting plates that mount a marine propulsion device to a hull at an opening with a sealing grommet.

U.S. Pat. No. 8,011,983 discloses a marine drive that has a break-away mount mounting first and second sections of the drive and breaking-away in response to a given underwater impact against the second section to protect the first section and the vessel.

U.S. patent application Ser. No. 14/267,441, filed May 1, 2014, discloses apparatuses for mounting a marine drive to a hull of a marine vessel. An outer clamping plate faces an outside surface of the hull and an inner clamping plate faces an opposing inside surface of the hull. A marine drive housing extends through the hull. The marine drive housing is held in place with respect to the hull by at least one vibration dampening sealing member that is disposed between the inner and outer clamping plates. A first connector extends through the hull and clamps the outer clamping plate to the outside surface of the hull. A second connector extends through the hull and clamps the inner clamping plate to the outer clamping plate. The inner and outer clamping plates are held at a fixed distance from each other so that a consistent compression force is applied to the vibration dampening sealing member.

SUMMARY

Examples of a marine vessels and apparatuses for mounting stern drives to marine vessels are described with reference to the following Figures. The same numbers are used throughout the Figures to reference like features and like components.

A stern drive is for a marine vessel. In certain examples, the stern drive comprises a gimbal housing that is configured for connection to the marine vessel, a gimbal ring that is steerable with respect to the gimbal housing about a vertical steering axis, a driveshaft housing that is connected to the gimbal ring, and a trim actuator that is configured to trim the driveshaft housing about a horizontal trim axis. The trim actuator has a first end that is pivotably connected to the gimbal ring at a horizontal first pivot axis and a second end that is pivotably connected to the driveshaft housing at a horizontal second pivot axis. A resilient driveshaft housing vibration isolator is located along the second pivot axis. The resilient vibration isolator isolates vibration forces on the driveshaft housing. A resilient gimbal ring vibration isolator is located along the trim axis. The gimbal ring vibration isolator isolates vibration forces on the gimbal ring. The stern drive has a center of gravity that is located between the gimbal ring vibration isolator and the trim actuator vibration isolator. The gimbal ring vibration isolator can comprise port and starboard gimbal ring vibration isolators, wherein the center of gravity is further located between the port and starboard gimbal ring vibration isolators. The gimbal ring vibration isolator and the a trim actuator resilient vibration isolator operate together to isolate vibration forces on the stern drive.

BRIEF DESCRIPTION OF THE DRAWINGS

Examples of a marine vessels and apparatuses for mounting stern drives to marine vessels are described with reference to the following Figures. The same numbers are used throughout the Figures to reference like features and like components.

DETAILED DESCRIPTION OF THE DRAWINGS

Figure 1:
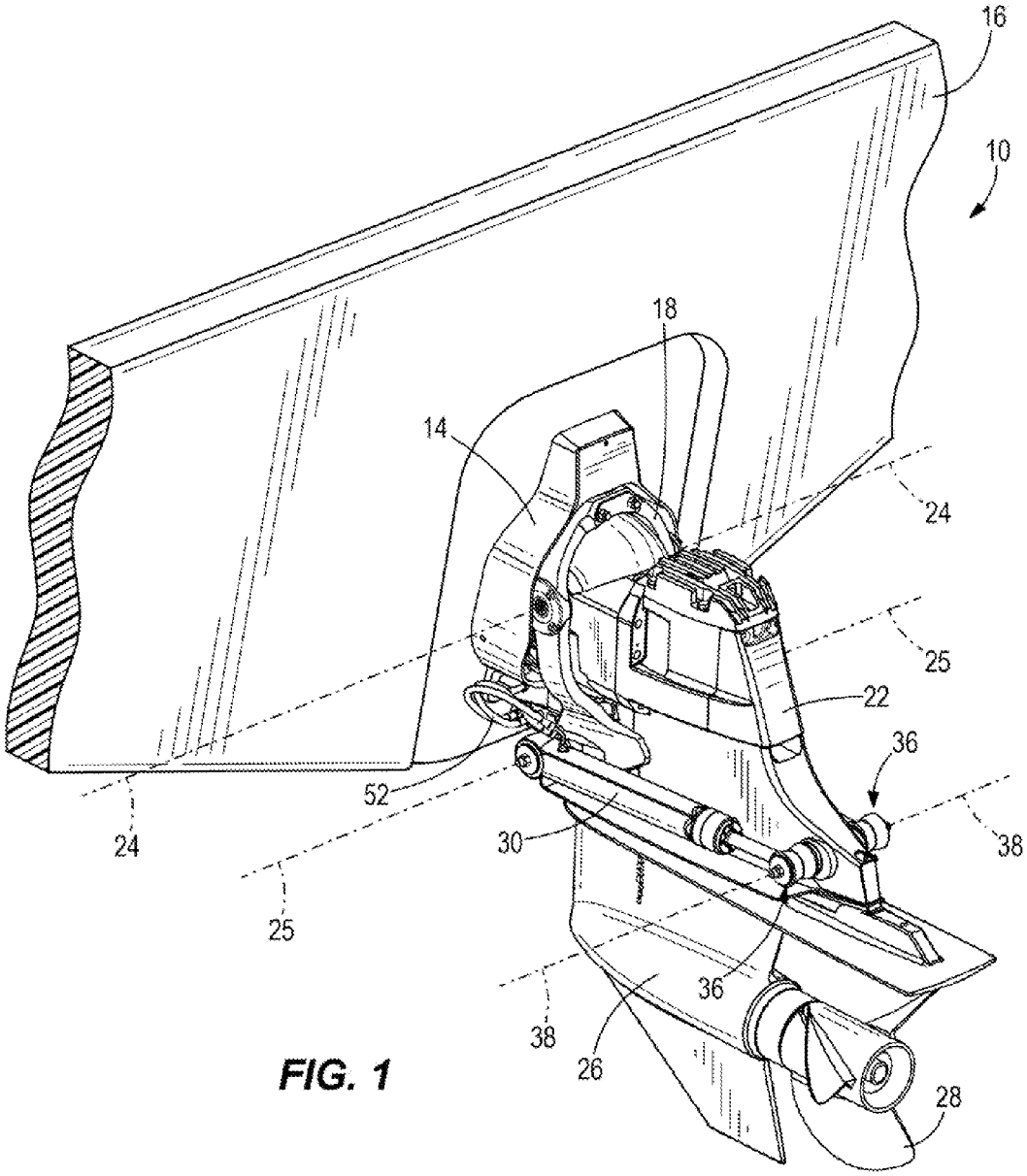
FIG. 1 is a perspective view of a stern drive on a transom of a marine vessel.

FIG. 1 depicts a stern drive 10 for a marine vessel. The stern drive 10 includes a gimbal housing 14 that is configured for connection to a transom 16 of the marine vessel, for example as shown in the incorporated U.S. patent application Ser. No. 14/267,441. The stern drive 10 also includes a gimbal ring 18 that is steerable with respect to the gimbal housing 14, as is conventional, about a vertical steering axis 20 (see FIG. 2). A drive shaft housing 22 is connected to the gimbal ring 18 and is trimmable about a horizontal trim axis 24 between a trimmed down position (FIG. 3) and a trimmed up position (FIG. 4). A gear case housing 26 depends from the drive shaft housing 22 and incorporates a conventional transmission for driving a propeller 28 into rotation. As is known in the art, rotation of the propeller 28 creates a thrust force on the stern drive 10, which is transferred to the marine vessel via the transom 16, to thereby propel the marine vessel in a direction according to the steering angle of the gimbal ring 18.

Figure 2:
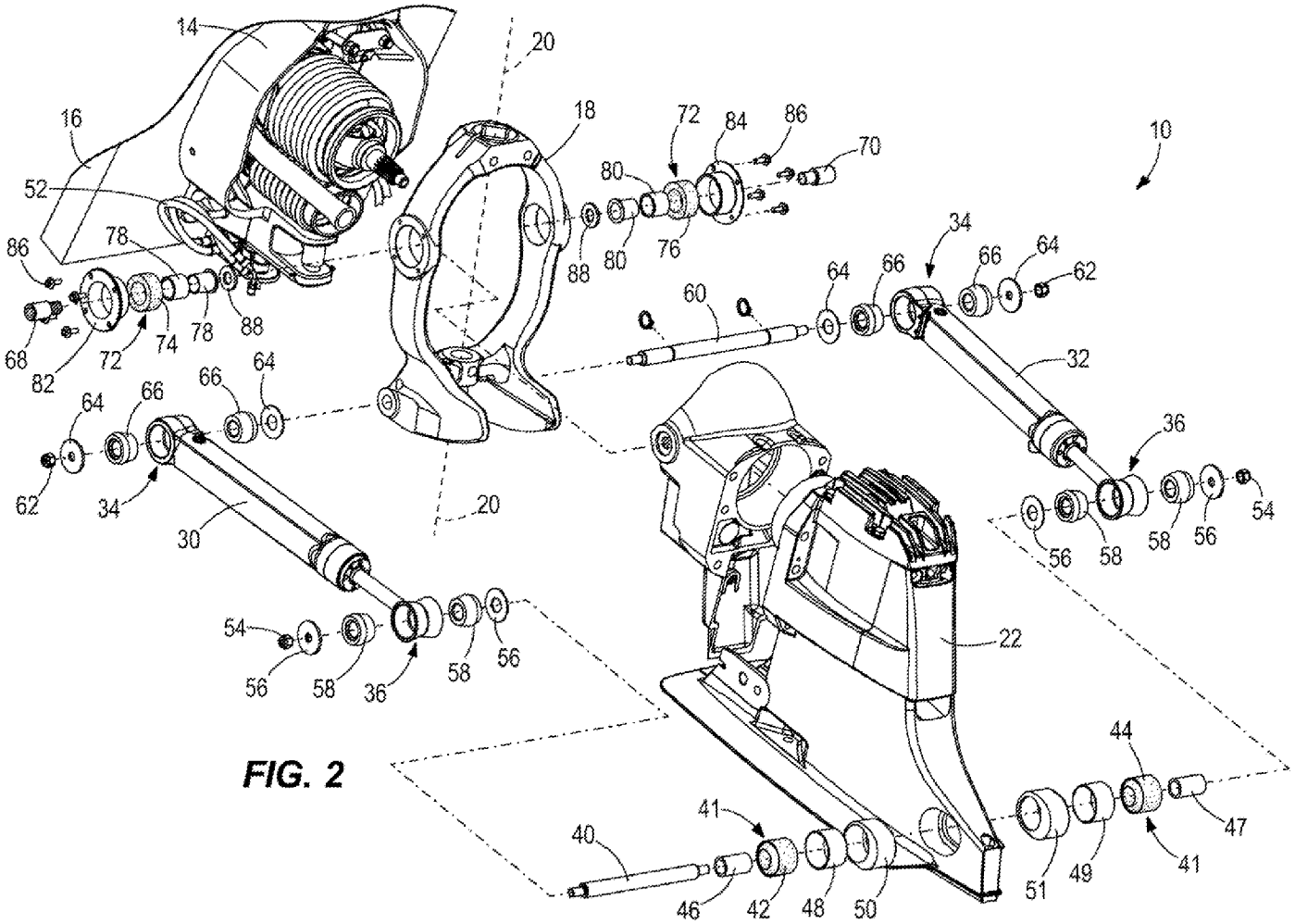
FIG. 2 is an exploded view of the stern drive.

Referring to FIGS. 1 and 2 the stern drive 10 includes port and starboard trim actuators 30, 32 which are located on opposite sides of the drive shaft housing 22. In this example, the port and starboard trim actuators 30, 32 are hydraulic piston-cylinders that receive pressurized hydraulic fluid via hydraulic lines 52. Each of the port and starboard trim actuator 30, 32 has a first end 34 that is pivotably connected to the gimbal ring 18 along a horizontal first pivot axis 25 and a second end 36 that is pivotably connected to the drive shaft housing 22 along a horizontal second pivot axis 38. The horizontal second pivot axis 38 is located aftwardly of the horizontal first pivot axis 25.

Figure 7:
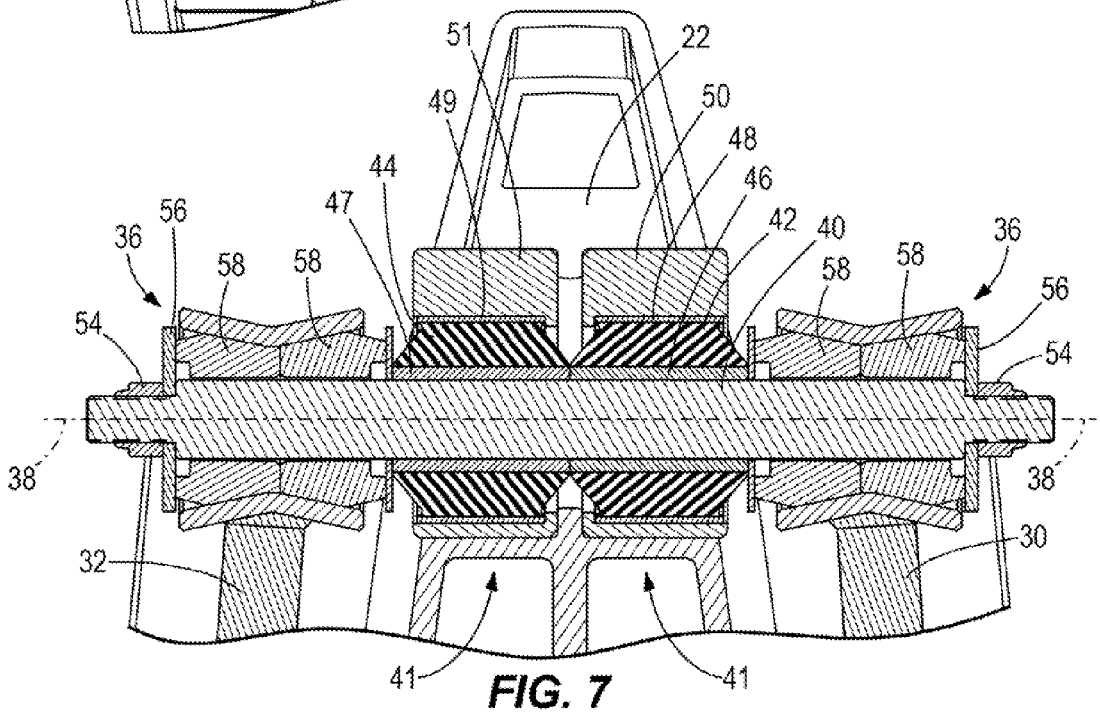
FIG. 7 is a view of section 7-7 taken in FIG. 3.

As shown in FIGS. 2 and 7, a pivot shaft 40 extends along the second pivot axis 38 between the port and starboard trim actuators 30, 32, which are disposed on opposite sides of the drive shaft housing 22. A resilient drive shaft housing vibration isolator 41 is located along the second pivot axis 38. In this example, the driveshaft housing vibration isolator 41 includes port and starboard rubber cylinders 42, 44, which are disposed on the pivot shaft 40. The port and starboard rubber cylinders 42, 44 are disposed next to each other along the pivot shaft 40. Metal sleeves 46, 47 are disposed between the pivot shaft 40 and the respective port and starboard rubber cylinders 42, 44. Metal sleeves 48, 49 are disposed on the respective port and starboard rubber cylinders 42, 44. Metal housings 50, 51 reside in the drive shaft housing 22 and contain the metal sleeves 46, 47, rubber cylinders 42, 44, and metal sleeves 48, 49. In this manner, the metal housings 50, 51 are effectively disposed on the respective rubber cylinders 42, 44, and the rubber cylinders 42, 44 are disposed between the pivot shaft 40 and the drive shaft housing 22. The resilient drive shaft housing vibration isolator 41, which is disposed on the pivot axis 38, isolates vibration forces on the drive shaft housing 22, as explained further herein below.

The respective second ends 36 of the port and starboard trim actuators 30, 32 are connected to port and starboard ends of the pivot shaft 40. Opposing threaded nuts 54 engage with the ends of the pivot shaft 40 to secure the second ends 36 of the trim actuators 30, 32. Washers and bearings 56, 58 are disposed on opposite sides of the noted second ends 36 to retain the second ends 36 in place with respect to the pivot shaft 40 such that the second ends 36 are freely pivotable with respect to the pivot shaft 40 and the drive shaft housing 22.

As shown in FIG. 2, the respective first ends 34 of the port and starboard trim actuators 30, 32 are connected to port and starboard ends of a horizontally extending pivot shaft 60 that extends through the gimbal ring 18. Opposing threaded nuts 62 engage with ends of the pivot shaft 60 to secure the first ends 34 of the trim actuators 30, 32. Washers and bearings 64, 66 are disposed on opposite sides of the noted first ends 34 to retain the first ends 34 in place with respect to the pivot shaft 60 such that the first ends 34 are freely pivotable with respect to the pivot shaft 60 and the gimbal ring 18.

Figure 6:
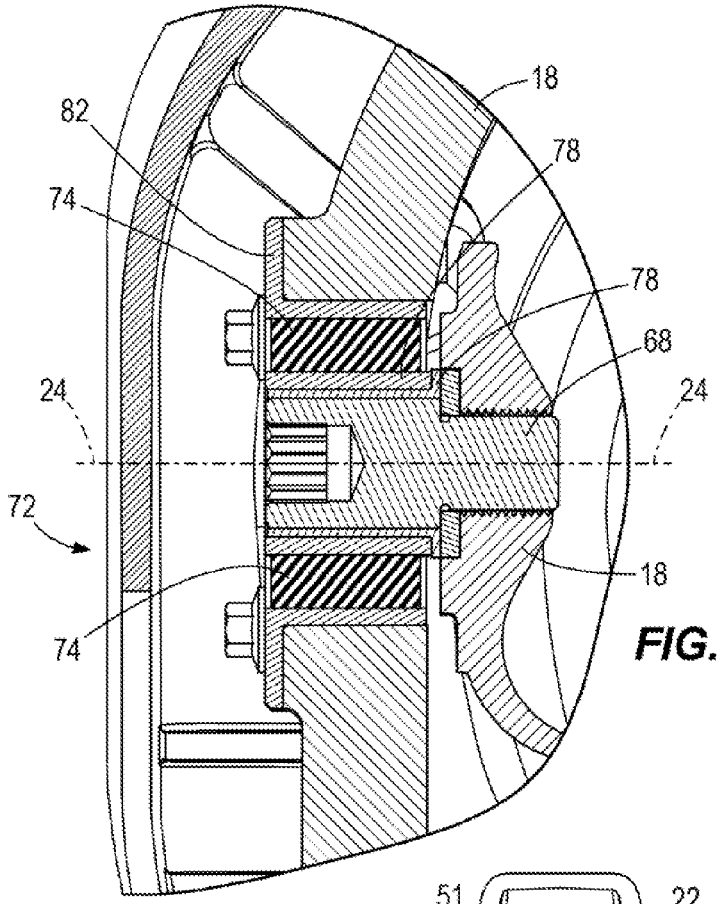
FIG. 6 is a view of section 6-6 taken in FIG. 3.

As shown in FIGS. 2 and 6, port and starboard pivot pins 68, 70 connect the driveshaft housing 22 to the gimbal ring 18 at the trim axis 24. A gimbal ring vibration isolator 72 includes port and starboard rubber cylinders 74, 76 that are disposed on the port and starboard pivot pins 68, 70, respectively. Metal sleeves 78, 80 are disposed between the port and starboard rubber cylinders 74, 76 and the respective port and starboard pivot pins 68, 70. Metal housings 82, 84 are disposed on the respective port and starboard rubber cylinders 74, 76. As such, each rubber cylinder 74, 76 is disposed between the respective port and starboard pivot pin 68, 70 and the gimbal ring 18. Fasteners 86 attach the metal housings 82, 84 to the gimbal ring 18 along the trim axis 24. Washers 88 are disposed on the pivot pins 68, 70.

Figure 3:
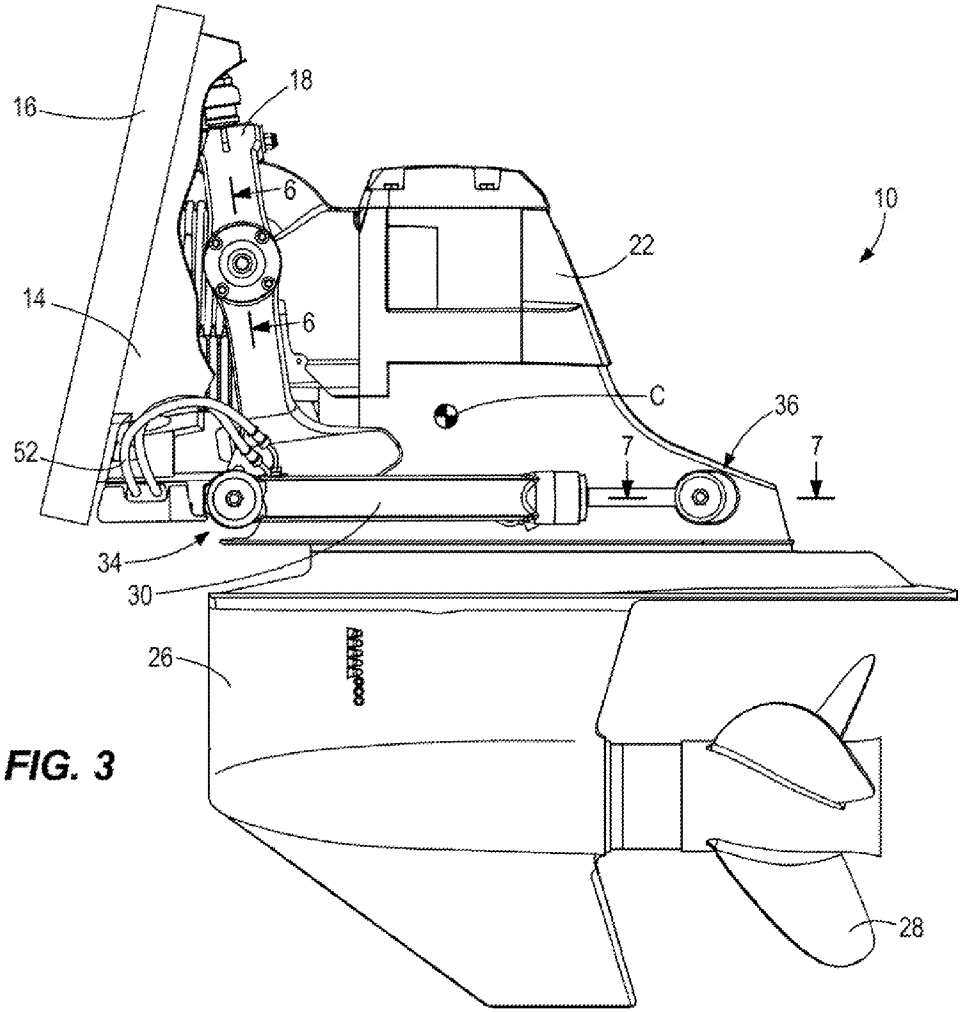
FIG. 3 is a side view of the stern drive in a trimmed-down position.
Figure 4:
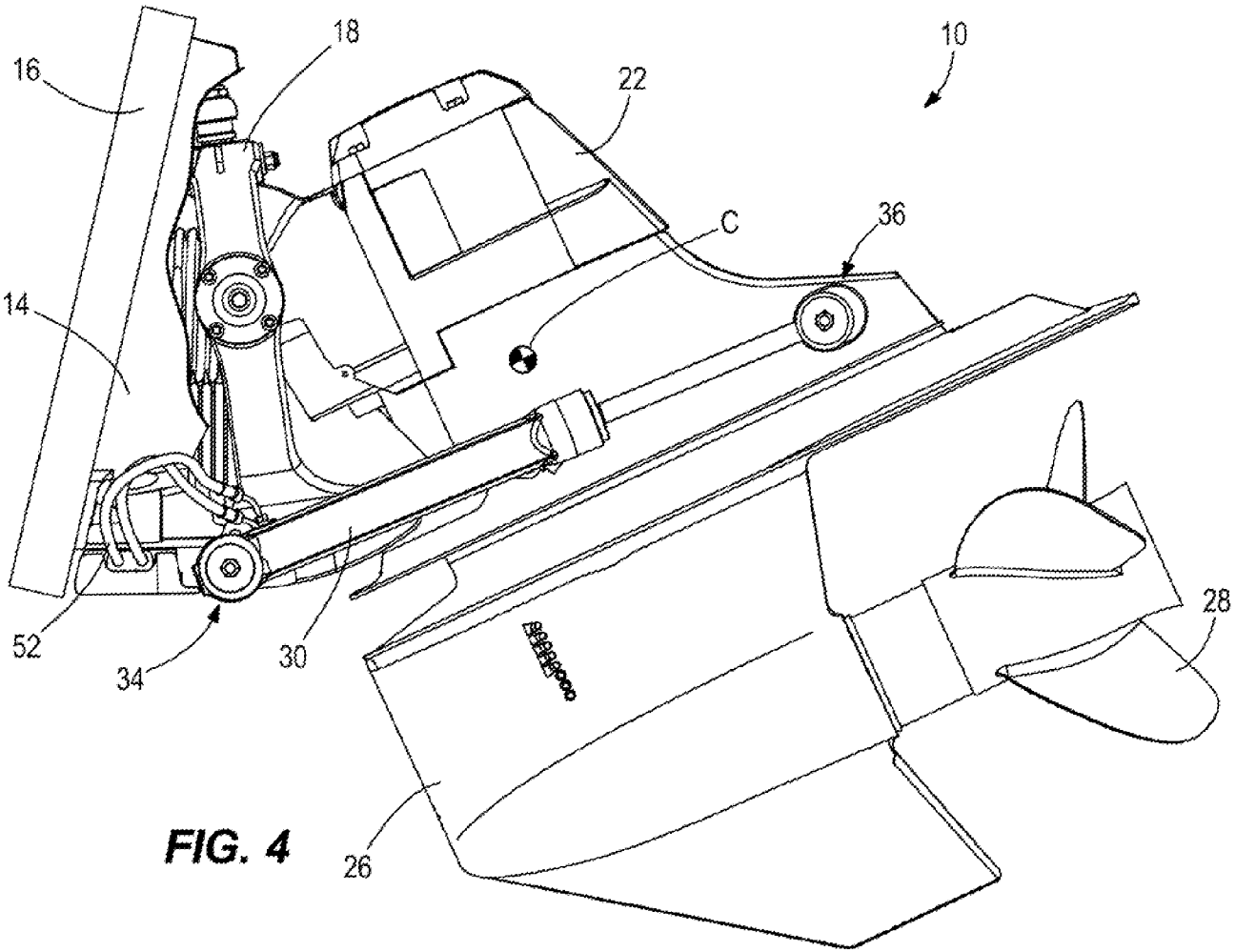
FIG. 4 is a side view of the stern drive in a trimmed-up position.
Figure 5:
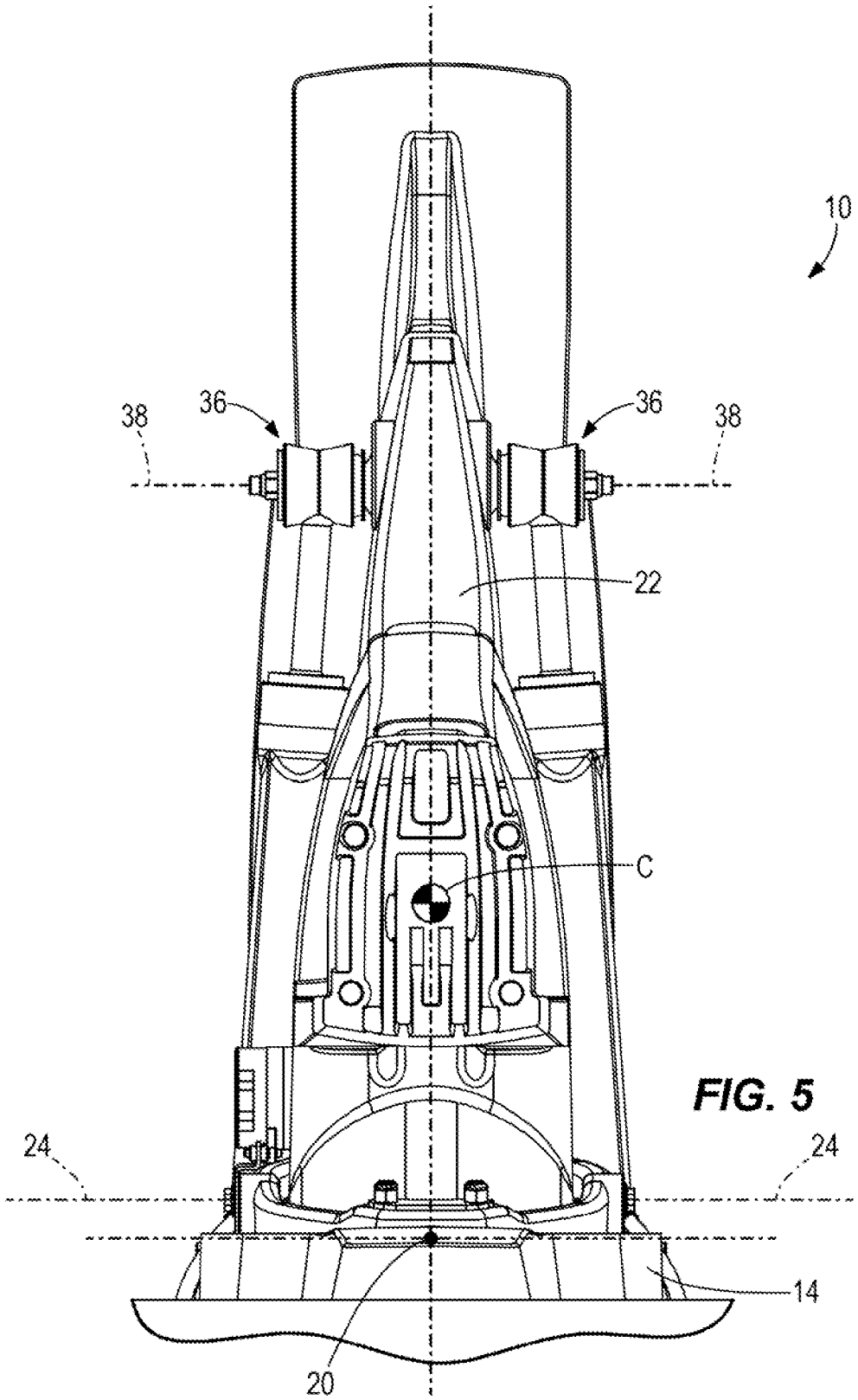
FIG. 5 is a top view of the stern drive.

As shown in FIGS. 3-5, the stern drive 10 has a center of gravity C that is located between the gimbal ring vibration isolator 72 and the driveshaft housing vibration isolator 41. The center of gravity C is further located between the port and starboard rubber cylinders 74, 76. The gimbal ring vibration isolator 72 and the driveshaft housing vibration isolator 41 together operate to isolate vibration forces on the stern drive 10. This advantageously allows for isolation of the forces with respect to the marine vessel without requiring changes to the connection between the gimbal housing 14 and the transom 16 of the marine vessel.

In the present description, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims.

What is claimed is:

1. A stern drive for a marine vessel, the stern drive comprising:

a gimbal housing that is configured for connection to the marine vessel, a gimbal ring that is steerable with respect to the gimbal housing about a vertical steering axis;

a driveshaft housing that is connected to the gimbal ring;

a trim actuator that is configured to trim the driveshaft housing about a horizontal trim axis, wherein the trim actuator has a first end that is pivotably connected to the gimbal ring at a horizontal first pivot axis and a second end that is pivotably connected to the driveshaft housing at a horizontal second pivot axis;

a resilient driveshaft housing vibration isolator located along the horizontal second pivot axis, wherein the resilient vibration isolator isolates vibration forces on the driveshaft housing;

a resilient gimbal ring vibration isolator located along the trim axis, wherein the gimbal ring vibration isolator isolates vibration forces on the gimbal ring;

wherein the horizontal first pivot axis is located vertically below the trim axis and wherein the horizontal second pivot axis is located aftwardly of the trim axis;

wherein the stern drive has a center of gravity that is located between the driveshaft housing vibration isolator and the gimbal ring vibration isolator;

wherein the trim actuator is one of a port and a starboard trim actuator, which are located on opposite sides of the driveshaft housing, wherein each of the port and starboard trim actuators having a first end that is pivotably connected to the gimbal ring at the horizontal first pivot axis and a second end that is pivotably connected to the driveshaft housing at the horizontal second pivot axis;

a pivot shaft that extends along the horizontal second pivot axis between the second ends of the port and starboard trim actuators; and wherein the driveshaft housing vibration isolator comprises a rubber cylinder disposed on the pivot shaft; and a metal sleeve disposed between the pivot shaft and the rubber cylinder.

2. The stern drive according to claim 1, wherein the rubber cylinder is one of a port and a starboard rubber cylinder which are disposed next to each other along the pivot shaft.

3. The stern drive according to claim 1, further comprising a metal housing disposed on the rubber cylinder.

4. The stern drive according to claim 1, wherein the rubber cylinder is disposed between the pivot shaft and the driveshaft housing.

5. A stern drive for a marine vessel, the stern drive comprising:

a gimbal housing that is configured for connection to the marine vessel;

a gimbal ring that is steerable with respect to the gimbal housing about a vertical steering axis;

a driveshaft housing that is connected to the gimbal ring;

a trim actuator that is configured to trim the driveshaft housing about a horizontal trim axis, wherein the trim actuator has a first end that is pivotably connected to the gimbal ring at a horizontal first pivot axis and a second end that is pivotably connected to the driveshaft housing at a horizontal second pivot axis;

a resilient driveshaft housing vibration isolator located along the horizontal second pivot axis, wherein the resilient vibration isolator isolates vibration forces on the driveshaft housing; and a resilient gimbal ring vibration isolator located along the trim axis, wherein the gimbal ring vibration isolator isolates vibration forces on the gimbal ring; and port and starboard pivot pins that connect the driveshaft housing to the gimbal ring at the trim axis, and wherein the gimbal ring vibration isolator is one of port and starboard gimbal ring vibration isolators that are disposed on the port and starboard pivot pins, respectively.

6. The stern drive according to claim 5, wherein the second pivot axis is located aftwardly of the trim axis and wherein the stern drive has a center of gravity that is located between the gimbal ring vibration isolator and the trim actuator vibration isolator.

7. The stern drive according to claim 6, wherein the center of gravity is further located between the port and starboard gimbal ring vibration isolators.

8. The stern drive according to claim 7, wherein each of the port and starboard gimbal ring vibration isolators comprise a rubber cylinder disposed on the port and starboard pivot pins, respectively.

9. The stern drive according to claim 8, further comprising a metal sleeve disposed between the rubber cylinder and the respective port and starboard pivot pins.

10. The stern drive according to claim 8, further comprising a metal housing disposed on the rubber cylinder.

11. The stern drive according to claim 8, wherein each rubber cylinder is disposed between the port and starboard pivot pins and the gimbal ring, respectively.

12. The stern drive according to claim 5, wherein the gimbal ring vibration isolator and the trim actuator vibration isolator together isolate forces that would otherwise cause vibration of the stern drive.

13. A stern drive for a marine vessel, the stern drive comprising:

a gimbal housing that is configured for connection to the marine vessel;

a gimbal ring that is steerable with respect to the gimbal housing about a vertical steering axis;

a driveshaft housing that is connected to the gimbal ring;

a trim actuator that is configured to trim the driveshaft housing about a horizontal trim axis, wherein the trim actuator has a first end that is pivotably connected to the gimbal ring at a horizontal first pivot axis and a second end that is pivotably connected to the driveshaft housing at a horizontal second pivot axis;

a resilient driveshaft housing vibration isolator located along the horizontal second pivot axis, wherein the resilient vibration isolator isolates vibration forces on the driveshaft housing; and a resilient gimbal ring vibration isolator located along the trim axis, wherein the gimbal ring vibration isolator isolates vibration forces on the gimbal ring;

wherein the stern drive has a center of gravity that is located between the gimbal ring vibration isolator and the driveshaft housing vibration isolator, wherein the gimbal ring vibration isolator comprises port and starboard gimbal ring vibration isolators, wherein the center of gravity is further located between the port and starboard gimbal ring vibration isolators, and wherein the gimbal ring vibration isolator and the driveshaft housing vibration isolator operate together to isolate vibration forces on the stern drive.

14. The stern drive according to claim 13, wherein the trim actuator comprises a piston-cylinder.

* * * * *